US010793990B2

(12) United States Patent
Chun et al.

(10) Patent No.: US 10,793,990 B2
(45) Date of Patent: Oct. 6, 2020

(54) METHOD FOR CONTROLLING WASHING MACHINE

(71) Applicant: LG ELECTRONICS INC., Seoul (KR)

(72) Inventors: Manho Chun, Seoul (KR); Jeonguk Lee, Seoul (KR); Taehee Lee, Seoul (KR); Joonho Pyo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 47 days.

(21) Appl. No.: 16/283,608

(22) Filed: Feb. 22, 2019

(65) Prior Publication Data

US 2019/0264369 A1 Aug. 29, 2019

(30) Foreign Application Priority Data

Feb. 23, 2018 (KR) ..... 10-2018-0022110

(51) Int. Cl.
*D06F 37/36* (2006.01)
*D06F 37/30* (2020.01)
(Continued)

(52) U.S. Cl.
CPC ..... *D06F 37/36* (2013.01); *D06F 33/00* (2013.01); *D06F 37/30* (2013.01); *D06F 37/304* (2013.01);
(Continued)

(58) Field of Classification Search
CPC ..... D06F 33/00; D06F 37/30; D06F 37/36; D06F 37/40; D06F 2204/065;
(Continued)

(56) References Cited

U.S. PATENT DOCUMENTS 6,202,451 B1 * 3/2001 Park ..... D06F 37/40 68/133
7,454,929 B2 * 11/2008 Cho ..... D06F 37/304 68/12.01
(Continued)

FOREIGN PATENT DOCUMENTS

JP 2006-517126 A 7/2006
KR 10-1995-0006113 A 3/1995
(Continued)

*Primary Examiner* — Joseph L. Perrin
(74) *Attorney, Agent, or Firm* — Birch, Stewart, Kolasch & Birch, LLP

(57) ABSTRACT

A method of controlling a washing machine includes rotating a motor for driving an inner shaft in a first direction, and aligning a clutch to a reference position corresponding to one of a maximum lowered position and a maximum raised position. The motor is rotated by a preset reference alignment angle in a second direction to align the clutch from the reference position to a starting position corresponding to one of an upper limit and a lower limit of a preset agitating control section. The upper limit of the agitating control section is spaced downward by a first distance from the maximum raised position, and the lower limit of the agitating control section is spaced upward by a second distance from the maximum lowered position. The motor is rotated by a starting alignment angle set according to a displacement of the clutch ranging from the starting position to a target position corresponding to the other one of the upper limit and the lower limit so that the clutch is moved from the starting position to the target position.

20 Claims, 9 Drawing Sheets

(51) Int. Cl.

| | |
|---|---|
| ***D06F 37/40*** | (2006.01) |
| ***D06F 33/00*** | (2020.01) |
| *D06F 21/08* | (2006.01) |

(52) U.S. Cl.
CPC ..... *D06F 37/40* (2013.01); *D06F 21/08* (2013.01); *D06F 2202/12* (2013.01); *D06F 2204/065* (2013.01); *D06F 2212/02* (2013.01); *D06F 2220/00* (2013.01)

(58) Field of Classification Search
CPC ..... D06F 2212/02; D06F 2220/00; D06F 2103/24; D06F 2105/46; D06F 2105/48; F16D 11/04; F16D 23/12; F16D 2023/123; F16H 1/28; F16H 25/20; F16H 57/02
See application file for complete search history.

(56) References Cited

U.S. PATENT DOCUMENTS

| | | | | |
|---|---|---|---|---|
| 2005/0223754 | A1* | 10/2005 | Choi | D06F 37/304 68/3 R |
| 2016/0168775 | A1* | 6/2016 | Kim | H02K 7/116 68/133 |
| 2016/0201747 | A1* | 7/2016 | Lv | H02K 7/10 192/12 D |
| 2017/0204551 | A1* | 7/2017 | Kim | D06F 37/40 |

FOREIGN PATENT DOCUMENTS

| | | | |
|---|---|---|---|
| KR | 10-2000-0063005 | A | 10/2000 |
| KR | 10-0734349 | B1 | 7/2007 |
| KR | 10-2012-0073927 | A | 7/2012 |
| KR | 10-1700763 | B1 | 1/2017 |

* cited by examiner

METHOD FOR CONTROLLING WASHING MACHINE

CROSS-REFERENCE TO RELATED APPLICATIONS

This application claims the priority benefit of Korean Patent Application No. 10-2018-0022110, filed on Feb. 23, 2018 in the Korean Intellectual Property Office, the disclosure of which is incorporated herein by reference.

BACKGROUND OF THE INVENTION

1. Field of the Invention

The present invention relates to a washing machine having a clutch system for connecting or disconnecting a washing shaft and a dewatering shaft, and a control method for the washing machine.

2. Description of the Related Art

In general, a washing machine is provided with an outer tub located in a casing, an inner tub located in the outer tub for receiving laundry and rotatable about a vertical axis, and a pulsator located in the inner tub for agitating the washing water.

The washing machine is provided with a motor for driving the inner tub and the pulsator. The driving force of the motor is transmitted through a double shaft structure having an inner shaft and an outer shaft. The inner shaft, as a shaft for rotating the pulsator, is directly connected to the motor, so that the pulsator is constantly rotated when the motor rotates. The outer shaft, as a shaft for rotating the inner tub, is configured to be connected to or disconnected from the inner shaft by a clutch.

That is, when the outer shaft and the inner shaft are connected by the clutch, the pulsator and the inner tub are rotated together. On the other hand, when the outer shaft is separated from the inner shaft, only the pulsator rotates in a state where the inner tub is stopped.

Korean Patent Publication No. 2000-0063005 discloses a clutch applied to a washing machine. The clutch includes a plurality of gears, a lever for operating the gears, and the like, so that the structure is complicated, and a separate motor for operating the gears and the lever is required.

A washing machine having a simplified clutch structure is disclosed in Korean Patent Publication No. 1993-0023530. This washing machine includes: a washing shaft having a first rotation protrusion formed on an outer circumferential surface thereof, a dewatering shaft having a first engaging protrusion formed on an inner circumferential surface thereof, and a switching unit which is interposed between the dewatering shaft and the washing shaft, and has an inner circumferential surface on which a second engaging protrusion interfering with the first rotation protrusion is formed and an outer circumferential surface on which a second engaging protrusion interfering with the first engaging protrusion is formed. When the washing shaft is rotated and the first rotation protrusion is caught by the first engaging protrusion, the switching unit is rotated. When the second rotation protrusion is caught by the second engaging protrusion due to rotation of the switching unit, the rotation of the dewatering shaft is performed.

Since only the washing shaft is rotated until the dewatering shaft is rotated, a mode in which only the washing shaft is rotated and a mode in which the washing shaft and the dewatering shaft are rotated together may be selectively implemented.

In such a structure, the protrusions formed in the washing shaft, the switching unit, and the dewatering shaft interfere with each other to transmit torque. However, it is practically difficult to ensure the strength and reliability of the protrusions, and there is a limit in the torque that may be transmitted through the protrusions, so that there is a problem that the torque is not able to cope with a large load. Further, when only the washing shafts are rotated alternately in both directions in a state where the dewatering shaft is stopped, there is a problem that noise frequently occurs caused by collisions between the protrusions.

SUMMARY OF THE INVENTION

The present invention has been made in view of the above problems, and provides a washing machine that has a clutch for connecting (coupling or shafting) or disconnecting an inner shaft (the shaft for rotating the pulsator) and an outer shaft (the shaft for rotating the inner tub) while the clutch is raised and lowered by the rotation of the inner shaft, and can precisely control the lifting range of the clutch, and a control method thereof.

When the clutch is positioned within a preset agitating control section, the inner shaft is rotated in a state in which the inner shaft is disconnected from the outer shaft. However, when the clutch is positioned at the upper limit or the lower limit of the agitating control section, the inner shaft and the outer shaft are connected. Thus, the inner shaft and the outer shaft are rotated in the same direction. Accordingly, the present invention further provides a washing machine which can accurately control the raising and lowering movement of the clutch so that the clutch does not reach the upper limit or the lower limit of the agitating control section, when performing an agitating motion in which the pulsator is rotated in both directions in a state in which the inner shaft is disconnected from the outer shaft, and a control method thereof.

Particularly, when the clutch reaches the upper limit or the lower limit of the agitating control section, an impact due to interference between components and an unnecessary noise may occur in the process where the clutch connects the inner shaft and the outer shaft. Accordingly, the present invention further provides a washing machine which can solve these problems, and a control method thereof.

In the washing machine of the present invention, a clutch interposed between an inner shaft and an outer shaft is threadably coupled to the inner shaft, and is spline coupled to the outer shaft. Since the spline coupling restrains the clutch from rotating relatively with respect to the outer shaft, the clutch is lifted along the inner shaft when the inner shaft is rotated.

The clutch is lifted within a preset range. That is, when the clutch reaches a preset maximum raised position, the clutch cannot rise any further, and when reaching a preset maximum lowered position, the clutch cannot lower any further.

Assuming that the direction in which the inner shaft is rotated to lift the clutch is referred to as a forward direction and the opposite direction is referred to as a reverse direction, if the inner shaft rotates in the forward direction so that the inner shaft continues to rotate in the forward direction even after the clutch reaches the maximum raised position, the clutch cannot be rotated any longer relatively with respect to the inner shaft (i.e., the clutch can no longer be relatively rotated with respect to the inner shaft). Therefore, the clutch is rotated integrally with the inner shaft, and at this time, the outer shaft is also rotated because the outer shaft is spline coupled with the clutch.

Likewise, when the inner shaft is rotated in the reverse direction and the clutch has reached the maximum lowered position, the clutch cannot lower any further (i.e., the clutch can no longer be relatively rotated with respect to the inner shaft). Therefore, the clutch is rotated integrally with the inner shaft, and at this time, the outer shaft is also rotated.

A method of controlling the washing machine includes a reference position aligning step of aligning the clutch to a reference position by rotating the motor in a first direction, and a starting position aligning step of aligning the clutch to a starting position by rotating the motor in a second direction (opposite direction to the first direction) in a state where the clutch is aligned with the reference position.

Here, the reference position may correspond to one of the maximum lowered position and the maximum raised position. When the reference position is the maximum lowered position, the first direction is the rotating direction of the motor when the inner shaft is rotated so that the clutch lowers.

The starting position is set to correspond to either the upper limit or the lower limit of the agitating control section. The upper limit of the agitating control section is spaced apart downward by a first distance from the maximum raised position and the lower limit of the agitating control section is spaced apart upward by a second distance from the maximum lowered position.

In the starting position aligning step, the motor is rotated by a preset reference alignment angle in the second direction to move the clutch from the reference position and align to the starting position.

Thereafter, a step of moving the clutch from the starting position to a target position corresponding to the other one of the upper limit and the lower limit of the agitating control section is performed. At this time, the rotation of the motor is controlled by a starting alignment angle set according to the displacement of the clutch from the starting position to the target position. A step of controlling the rotation of the motor may be further performed so that the clutch is returned from the target position to the starting position, and these steps may be repeated so that the clutch can repeatedly rise and lower within the agitating control section.

The reference position aligning step may be performed again when it is detected that the clutch is deviated from the agitating control section and reached a preset permitting position, while the rising and lowering of the clutch are being repeatedly performed.

Alternatively, the reference position aligning step may be performed again when a set time elapses while the rising and lowering of the clutch are being repeatedly performed.

The reference position aligning step comprises controlling the motor to rotate in the first direction at a reference alignment angle which is set according to the displacement of the clutch between the maximum raised position and the maximum lowered position.

The reference position aligning step comprises determining that the clutch has reached the reference position and braking the motor, when a current value of the motor is equal to or greater than a preset first current value, while the motor is being rotated in the first direction. The braking of the motor is performed based on the current value of the motor detected after a first set time is elapsed, after the motor is started in the first direction.

The reference position aligning step comprises determining that the clutch has reached the reference position and stopping the rotation of the motor, when a second current value corresponding to a current value of a time point when the motor is started within a second set time after the motor starts rotating in the first direction, a third current value corresponding to a current value of a time point when the clutch reaches the maximum raised position or the maximum lowered position and the inner shaft and the outer shaft are connected, and a fourth current value corresponding to a current value of a time point when the inner shaft and the outer shaft are connected and rotated integrally after the third current value is detected are sequentially detected.

The washing machine may further include a planetary gear train rotated by the motor. The planetary gear train comprises a ring gear fixed to an inner circumferential surface of a gear housing, a sun gear connected to a drive shaft of the motor, a plurality of pinion gears interposed between the sun gear and the ring gear and engaged with the sun gear and the ring gear, and a carrier rotatably supporting the plurality of pinion gears and rotating as the plurality of pinion gears revolve along the ring gear, and coupled with the inner shaft to rotate the inner shaft by the rotation.

BRIEF DESCRIPTION OF THE DRAWINGS

The objects, features and advantages of the present invention will be more apparent from the following detailed description in conjunction with the accompanying drawings.

DETAILED DESCRIPTION OF THE PREFERRED EMBODIMENTS

Exemplary embodiments of the present invention are described with reference to the accompanying drawings in detail. The same reference numbers are used throughout the drawings to refer to the same or like parts. Detailed descriptions of well-known functions and structures incorporated herein may be omitted to avoid obscuring the subject matter of the present invention.

Figure 1:
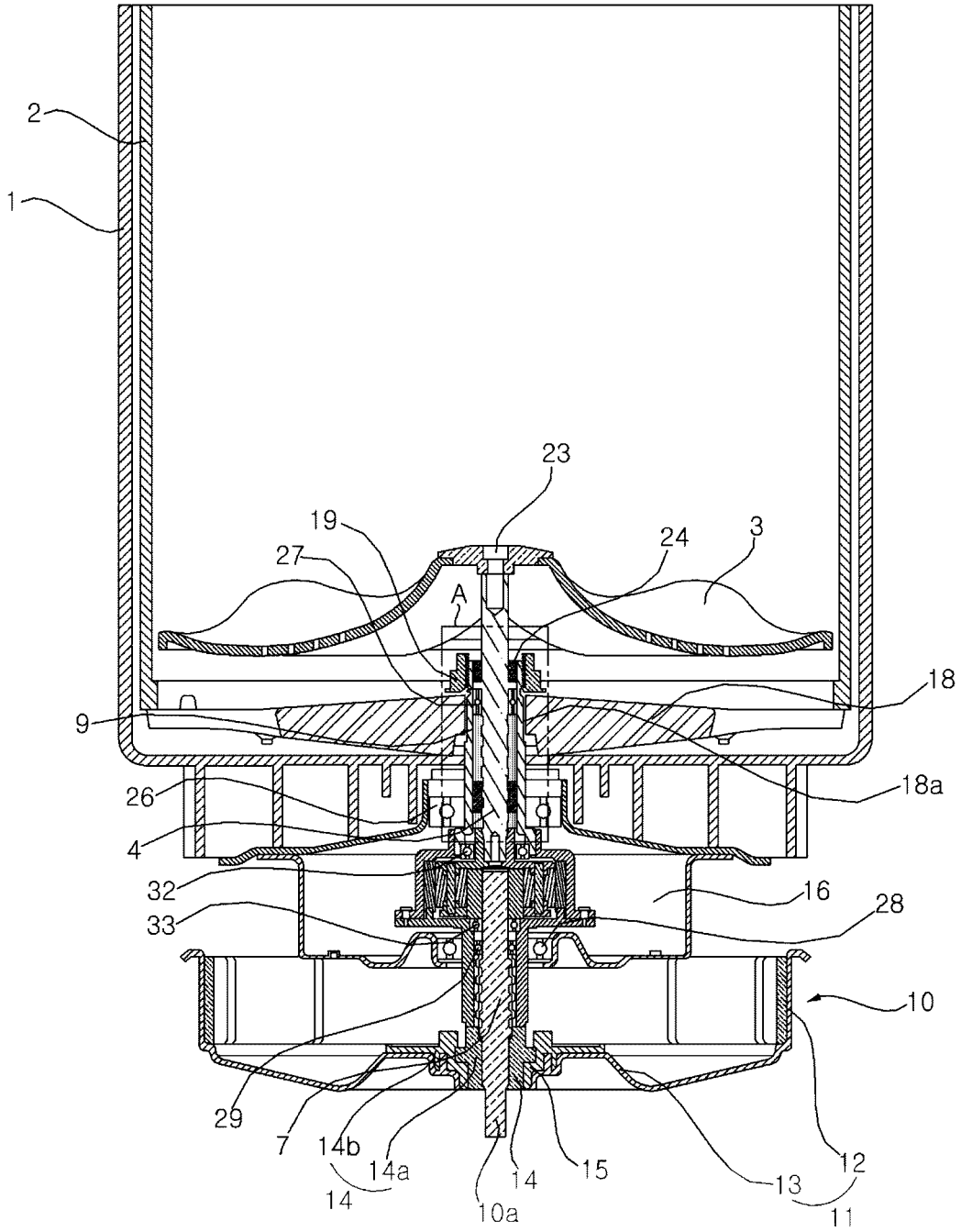
FIG. 1 is a longitudinal sectional view of a washing machine according to an embodiment of the present invention.
Figure 2:
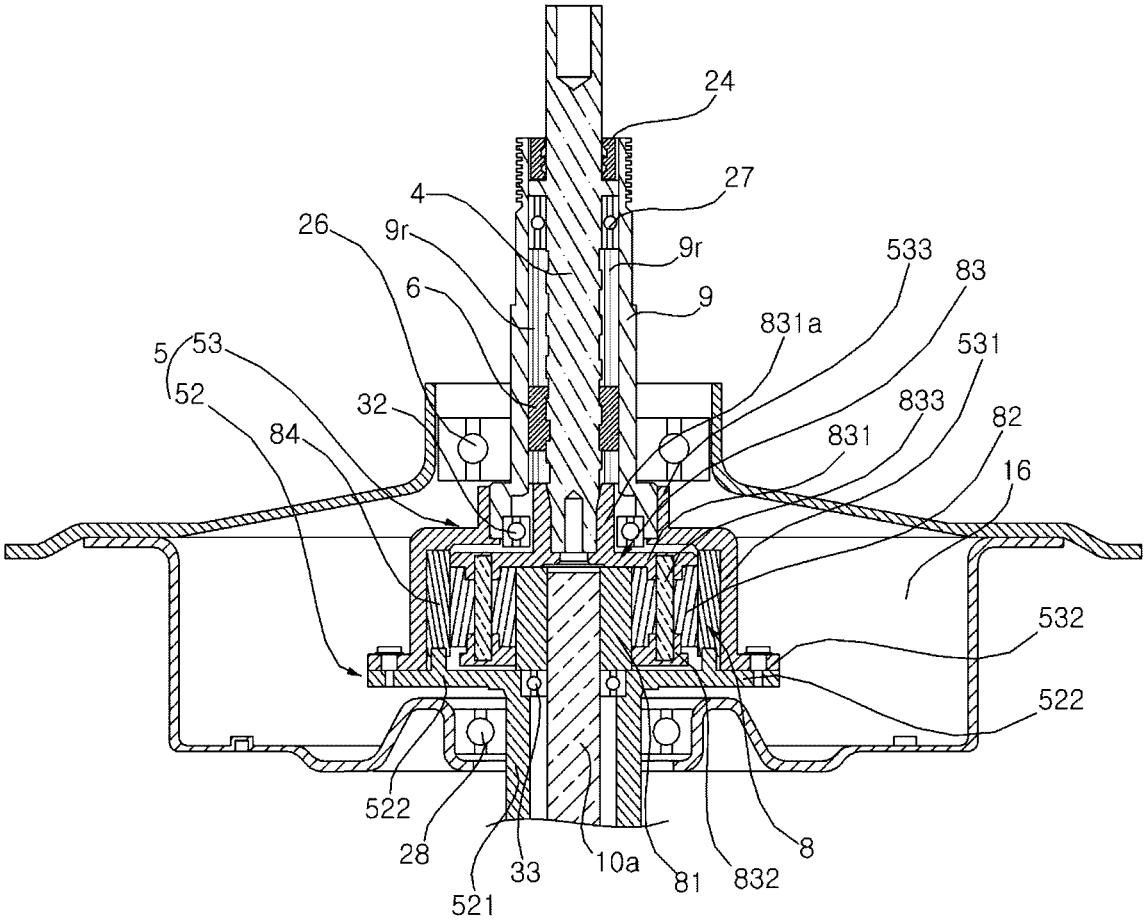
FIG. 2 is a partially enlarged view of the washing machine shown in FIG. 1.
Figure 3A:
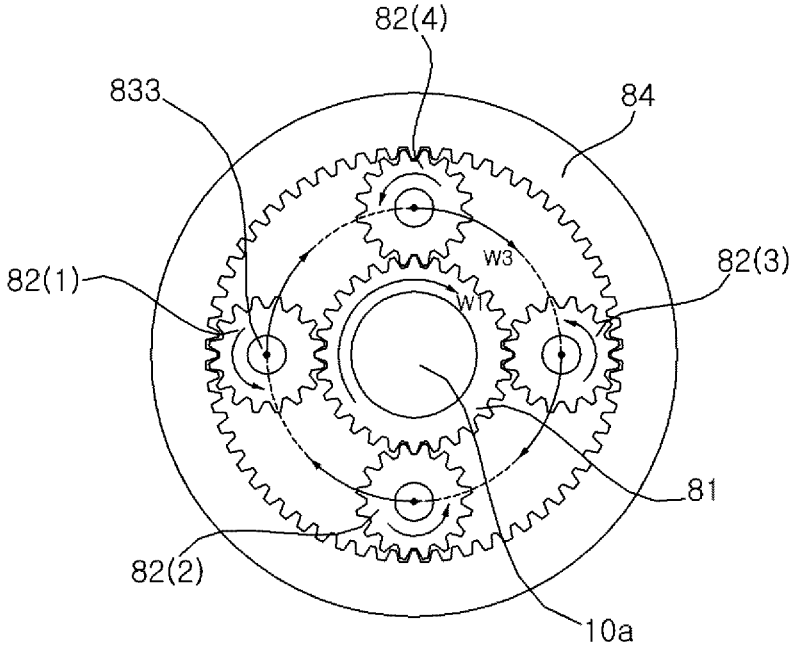
FIG. 3(*a*) schematically illustrates an operation of planetary gear train when a pulsator relatively rotates with respect to an inner tub, and FIG. 3(*b*) schematically illustrates an operation of the planetary gear train when the pulsator rotates along with the inner tub.
Figure 3B:
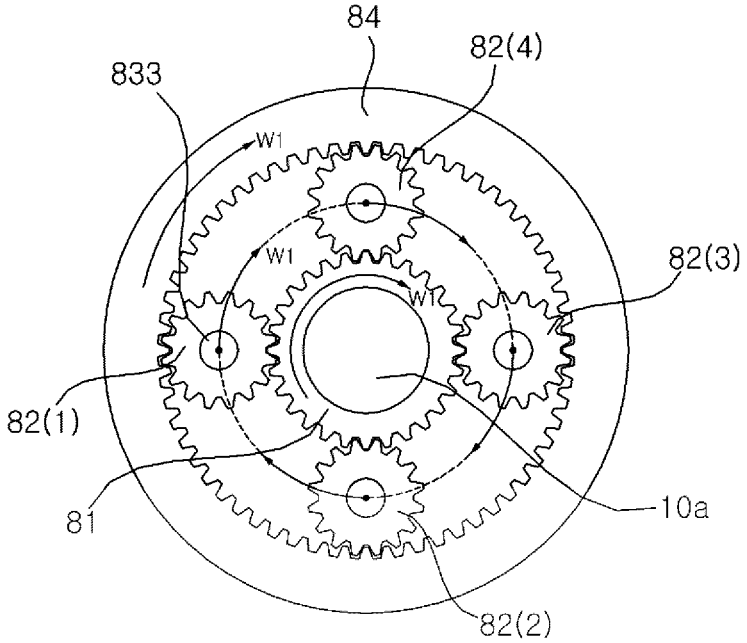
Figure 4A:
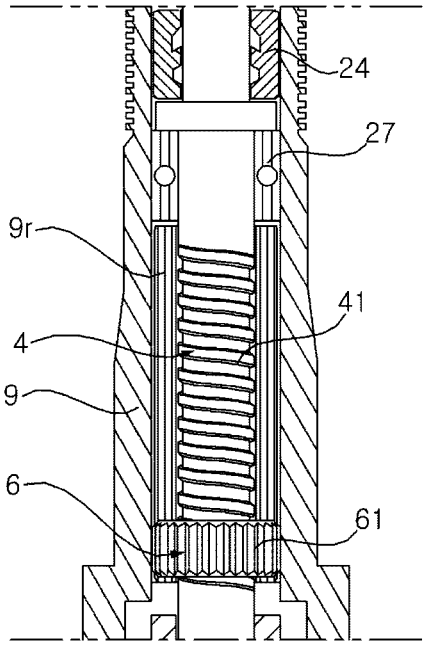
FIGS. 4(*a*) and 4(*b*) are partially cutaway views of a portion "A" in FIG. 1, FIG. 4(*a*) illustrates a state in which a clutch is in a maximum lowered position, and FIG. 4(*b*) illustrates a state in which the clutch is in a maximum raised position.
Figure 4B:
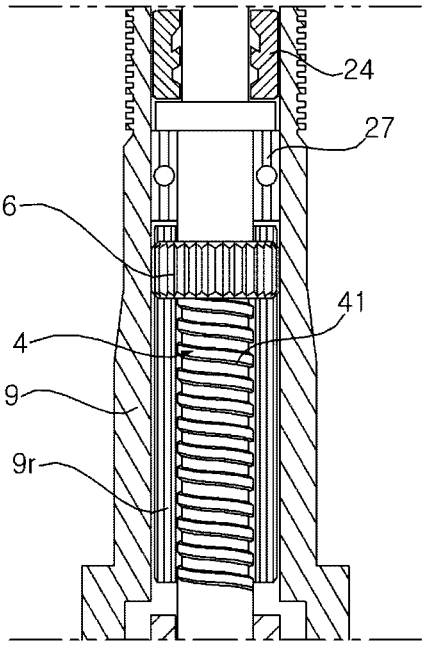
Figure 5:
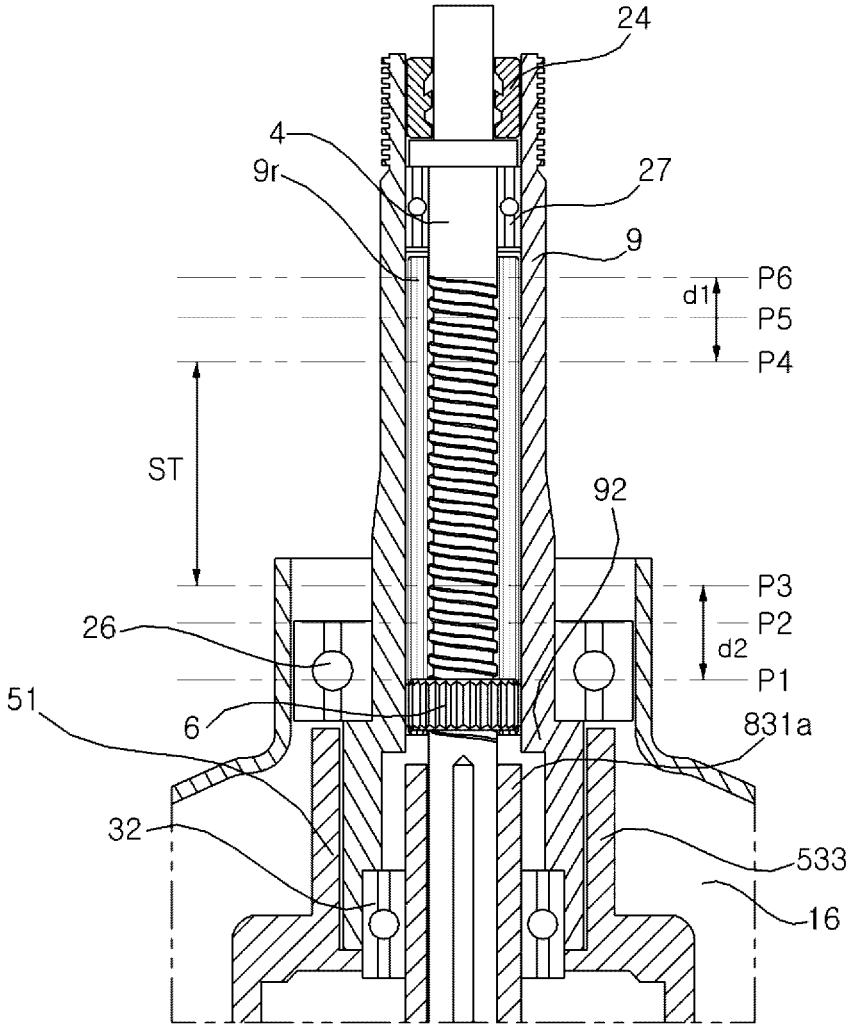
FIG. 5 illustrates positions referred to in a clutch position control.
Figure 6:
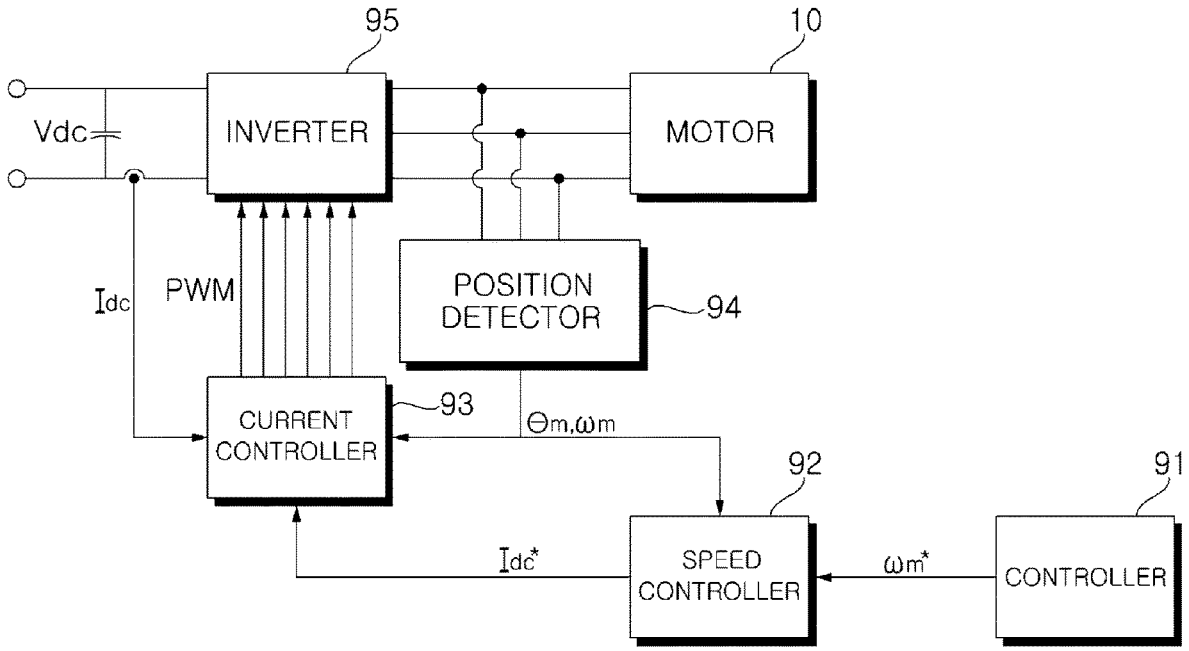
FIG. 6 is a block diagram illustrating the control relationship of main parts of a washing machine according to an embodiment of the present invention.

FIG. 1 is a longitudinal sectional view of a washing machine according to an embodiment of the present invention. FIG. 2 is a partially enlarged view of the washing machine shown in FIG. 1. FIG. 3(*a*) schematically illustrates an operation of a planetary gear train when a pulsator relatively rotates with respect to an inner tub, and FIG. 3(*b*) schematically illustrates an operation of the planetary gear train when the pulsator rotates along with the inner tub. FIGS. 4(*a*) and 4(*b*) are partially cutaway views of a portion "A" in FIG. 1, FIG. 4(*a*) illustrates a state in which a clutch is in a maximum lowered position, and FIG. 4(*b*) illustrates a state in which the clutch is in a maximum raised position. FIG. 5 illustrates positions referred to in a clutch position control. FIG. 6 is a block diagram illustrating the control relationship of main parts of a washing machine according to an embodiment of the present invention.

Referring to FIGS. 1 to 6, a washing machine according to an embodiment of the present invention includes an outer tub 1 in which water is contained, an inner tub 2 which is disposed in the outer tub 1 and receives laundry and rotates about a vertical axis A, a pulsator 3 which is disposed in the inner tub 2, and a motor 10 which provides a rotational force.

The outer tub 1 is disposed in a casing (not shown) forming an outer shape of the washing machine. The outer tub 1 may be suspended in the casing by a support rod (not shown). A plurality of support rods may be provided. When vibration is generated due to the rotation of the inner tub 2, the outer tub 1 is lifted along the support rod, and a suspension (not shown) or a damper (not shown) for buffering the lifting motion of the outer tub 1 may be provided.

The motor 10 provides power for rotating the pulsator 3 and the inner tub 2, and is able to accomplish a forward/reverse rotation. Further, the motor 10 is able to control the rotation direction and the rotating speed. The motor 10 is preferably a brushless direct current electric motor (BLDC), but it is not necessarily limited thereto.

The motor 10 is of an outer rotor type in which a stator (not shown) having a wound induction coil is disposed in a center and a rotor 11 is rotated around the stator. The rotor 11 may include a bottom portion 13 and a ring-shaped side surface portion 12 extended upward from the bottom portion 13. A drive shaft 10*a* of the motor 10 may be connected to a rotor hub 15 fixed to the bottom portion 13 by the rotor bush 14. A plurality of magnets (not shown) are provided, along the circumferential direction, in an inner circumferential surface of the side surface portion 12 of the motor 10 so that the rotor 11 is rotated by a magnetic field acting between the stator and the magnets.

Referring to FIG. 6, a speed control system of the BLDC motor 10 may include a speed controller 92, a current controller 93, a position detector 94, and an inverter 95. Such a speed control system is widely used for the control of the BLDC motor.

When the motor 10 is a sensorless brushless DC electric (sensorless BLDC) motor, the position detector 94 may include a circuit for detecting a counter electromotive force of the motor 10. A controller 91 may detect a zero crossing point (ZCP) in the waveform of the counter electromotive force detected by the position detector 94, and detect the position of a rotator (or the rotor 11) of the motor 10. Further, the position detector 94 may obtain the rotation speed (ωm*) by differentiating the position of the rotator. Alternatively, the position detector 94 may be provided with a hall sensor for detecting the position or rotational speed of the rotator of the motor 10.

The speed controller 92 outputs a command current Idc* for enabling the rotational speed of the rotator to follow a command speed(ωm*) applied from the controller 91. The speed controller 92 may be configured of a proportional-integral controller (PI controller) or a proportional-integral-derivative controller (PID controller) that performs feedback control based on the current speed(ωm) applied from the position detector 94.

The output torque of the motor 10 is proportional to the magnitude of the phase current and the magnitude of the phase current is proportional to the input current Idc of the inverter 95. The current controller 93 generates a gating signal (PWM waveform) so that the input current Idc follows the command current Idc* applied from the speed controller 92, and the inverter 95 is driven according to the gating signal so that the motor 10 is rotated. Similarly to the speed controller 92, the current controller 93 may be configured of a proportional-integral controller or a proportional-integral-derivative controller.

A planetary gear train 8 is provided for receiving the rotational force of the drive shaft 10*a* and converting an output at a preset speed ratio or torque ratio to rotate the inner shaft 4. The planetary gear train 8 will be described later in more detail.

The inner shaft 4 is connected with the pulsator 3. A fastening hole is formed in the center of the pulsator 3, and a screw 23 that passed through the fastening hole from above may be fastened to the inner shaft 4.

An outer shaft 9 is connected to the inner tub 2 and has a cylindrical shape formed with a first hollow through which the inner shaft 4 passes. On the lower side of the inner tub 2, a hub base 18 connected with the bottom of the inner tub 2 may be provided. The bottom of the inner tub 2 may have an opening formed in a substantially central portion thereof. The fastening members such as screw and bolt pass through the portions where the hub base 18 contacts the circumference of the opening, and are fastened to the bottom of the inner tub 2.

When the outer shaft 9 is rotated, the hub base 18 is also rotated together with the outer shaft 9. The outer shaft 9 and the hub base 18 are interlocked (or engaged) with each other. The outer shaft 9 and the hub base 18 may be spline-connected. On the outer surface of the outer shaft 9, teeth constituting a spline may be formed. The hub base 18 is formed in a disk shape as a whole, and a boss 18*a* through which the outer shaft 9 passes may be formed at the central portion. The inner circumferential surface of the boss 18*a* may be formed with engagement grooves that engage with the teeth.

The outer shaft 9 may protrude upward after passing through the boss 18*a* in the center of the hub base 18, and such a protruded portion may be fastened to a nut 19. In addition, the protruded portion may be provided with a sealer 24 for sealing so that the water contained in the inner tub 2 does not enter into the first hollow of the outer shaft 9.

A bearing housing 16 may be disposed below the outer tub 1. The bearing housing 16 may be connected to the bottom surface of the outer tub 1. In the bearing housing 16, a bearing 26 for supporting the outer shaft 9 may be provided.

When the motor 10 is rotated, the inner shaft 4 is constantly rotated. On the other hand, in order for the inner tub 2 to rotate, the torque provided by the motor 10 should be transmitted from the inner shaft 4 to the outer shaft 9, and this function is achieved by the operation of the clutch 6.

The clutch 6 is disposed between the inner shaft 4 and the outer shaft 9. The clutch 6 is provided to be able to be raised and lowered in a state of being interlocked with (or engaged with) the outer shaft 9, and is screw-coupled with the inner shaft 4 so that the clutch 6 can be moved between a maximum lowered position (see FIG. 4(*a*)) and a maximum raised position (see FIG. 4(*b*)).

The outer circumferential surface of the clutch 6 and the inner circumferential surface of the outer shaft 9 confining the first hollow are spline-connected so that the clutch 6 can be raised and lowered with respect to the outer shaft 9. For example, at least one tooth 61 constituting a spline is formed in the outer circumferential surface of the clutch 6, and at least one engagement groove 9*r* (see FIG. 4) corresponding to at least one tooth 61 is formed in the inner circumferential surface of the outer shaft 9. The engagement grooves 9*r* are engaged with the teeth 61, respectively. Preferably, serrations having a triangular cross section of the teeth constituting the spline may be formed in the outer circumferential surface of the clutch 6 and the inner circumferential surface of the outer shaft 9 respectively so as to be engaged with each other. The spline-coupling is just one example of an anti-rotation interface interconnecting the clutch 6 and the outer shaft 9.

The teeth 61 formed in the outer circumferential surface of the clutch 6 are engaged with the teeth grooves 9*r* formed in the inner circumferential surface of the outer shaft 9. Thus, when the clutch 6 reaches the maximum raised position and cannot rise further, or reaches the maximum lowered position and cannot lower further, the torque is transmitted to the outer shaft 9 through the clutch 6 so that the clutch 6 and the outer shaft 9 are rotated together. This will be described later in more detail.

The clutch 6 is threadably connected to the inner shaft 4. A helix thread 41 is formed in the outer circumferential surface of the inner shaft 4 along an axial direction, and a thread (not shown) engaging with the thread 41 is formed in the inner circumferential surface of the clutch 6. That is, in the relationship between the inner shaft 4 and the clutch 6, the inner shaft 4 corresponds to an external thread, and the clutch 6 corresponds to an internal thread.

Since the outer circumferential surface of the clutch 6 is spline-connected with the inner circumferential surface of the outer shaft 9, and the inner shaft 4 and the clutch 6 are screwed to each other, when the inner shaft 4 is rotated in a state in which the vertical motion of the clutch 6 is not restrained, the clutch 6 rises or lowers depending on the rotation direction of the inner shaft 4 while relatively rotating with respect to the thread 41. Hereinafter, the rotation direction of the inner shaft 4 that causes the clutch 6 to rise is referred to as a forward direction, and the opposite direction is referred to as a reverse direction.

When the inner shaft 4 is rotated in the forward direction to reach the maximum raised position (see FIG. 4(*b*)), the clutch 6 is prevented from further rising. When the inner shaft 4 is continuously rotated in the forward direction in a state where the rising of the clutch 6 is restrained, the outer shaft 9 is also rotated in the forward direction.

On the other hand, when the inner shaft 4 is rotated in the reverse direction to reach the maximum lowered position (see FIG. 4(*a*)), further lowering of the clutch 6 is restrained. When the inner shaft 4 continues to rotate in the reverse direction while the lowering of the clutch 6 is restrained, the outer shaft 9 is also rotated in the reverse direction.

At least one of the maximum raised position and the maximum lowered position of the clutch 6 may be confined by the thread 41. That is, when the clutch 6 relatively rotates in the reverse direction with respect to the inner shaft 4 and reaches the upper end of the thread 41, the clutch 6 can no longer be rotated, so that the rising motion is restrained and the position of the clutch 6, at this time, becomes the maximum raised position.

On the other hand, when the clutch 6 relatively rotates in the forward direction with respect to the inner shaft 4 and reaches the lower end of the thread 41, the clutch 6 can no longer be rotated, so that the lowering movement is restrained and the position of the clutch 6, at this time, becomes the maximum lowered position.

Alternatively, it is possible to further include an upper stopper for restraining the rising of the clutch 6 and/or a lower stopper for restraining the lowering of the clutch 6. For example, a bearing 27 interposed between the inner shaft 4 and the outer shaft 9 may serve as the upper stopper. It is also possible that a bearing for the lower stopper is further provided.

For another example, a bush or a ring may be fitted in the inner shaft 4, or a protrusion may protrude from the outer circumferential surface of the inner shaft 4 to constitute the upper stopper or the lower stopper.

On the other hand, an area in which the clutch 6 is moved in the first hollow formed in the outer shaft 9 may be provided to the external side of the inner tub 2. Furthermore, the area in which the clutch 6 is moved may be provided to the lower side of the outer tub 1. Since the area (or the space for installing or operating the clutch 6) in which the clutch 6 is moved is not provided to the internal side of the inner tub 2, the pulsator 3 may be disposed in the bottom of the inner tub 2, as in a general washing machine.

The planetary gear train 8 transmits the rotational force of the motor 10 and rotates the inner shaft 4. The planetary gear train 8 may include a sun gear 81, a pinion gear 82, a carrier 83, and a ring gear 84. The planetary gear train 8 converts the torque inputted through the drive shaft 10*a* according to a set gear ratio and rotates the inner shaft 4. The gear ratio may be determined according to the design factor (e.g., the number of teeth) of the sun gear 81, the pinion gear 82, and the ring gear 84.

A gear housing 5 is shaft coupled (or joined) to the outer shaft 9 so that the gear housing 5 is rotated together with the outer shaft 9 when the outer shaft 9 is rotated. The planetary gear train 8 may be accommodated in the gear housing 5. The gear housing 5 may have a boss 533 formed in the upper portion thereof. In this case, the lower end of the outer shaft 9 is connected with the boss 533, so that the outer shaft 9 and the gear housing 5 are shaft coupled.

The gear housing 5 may include a lower housing 52 and an upper housing 53. The lower housing 52 and the upper housing 53 are connected to each other by a fastening member such as a screw or bolt. The lower housing 52 forms a second hollow having a cylindrical shape as a whole and extended in the vertical direction, and the drive shaft 10*a* is inserted into the second hollow.

The lower housing 52 may include a hollow shaft 521 forming the second hollow and a lower flange 522 extended outwardly in the radial direction from the upper end of the hollow shaft 521. A bearing 33 for supporting the hollow shaft 521 and the drive shaft 10*a* to rotate relative to each other may be interposed between the hollow shaft 521 and the drive shaft 10*a*. In addition, the bearing housing 16 may be provided with a bearing 28 for supporting the outer circumferential surface of the hollow shaft 521.

The upper housing 53 is disposed in the upper side of the lower housing 52. The upper housing 53 forms a certain accommodation space above the lower flange 522, and the planetary gear train 8 is disposed in the accommodation space. The accommodation space is extended along the vertical direction as a whole, and the upper side and the lower side are respectively opened.

The upper housing 53 is formed with a boss 533 connected to the outer shaft 9 and the upper side of the receiving space is opened by the bosses 533. The upper housing 53 may include a housing main body 531 defining an inner circumferential surface surrounding the ring gear 84 and an upper flange 532 extended outwardly along the radial direction from the opened lower side of the housing main body 531 to be connected with the lower flange 522. The boss 533 may be extended upward from the housing main body 531.

The sun gear 81 is connected to the drive shaft 10*a*, and is rotated integrally with the drive shaft 10*a*. In the embodiment, the sun gear 81 is a helical gear. Correspondingly, the pinion gear 82 and the ring gear 84 are also configured to have teeth in the form of a helical gear, but are not necessarily limited thereto. For example, the sun gear 81 may be a spur gear, and the pinion gear 82 and the ring gear 84 may also have teeth in the form of a spur gear.

The ring gear 84 may be fixed within the housing main body 531 (or with respect to the housing main body 531). That is, the ring gear 84 is rotated integrally with the gear housing 5. The ring gear 84 is provided with teeth formed on the inner circumferential surface confining the ring-shaped opening.

The pinion gear 82 is interposed between the sun gear 81 and the ring gear 84, and engaged with the sun gear 81 and the ring gear 84. As for the pinion gear 82, a plurality of pinion gears 82(1), 82(2), 82(3), 82(4) may be disposed along the circumference of the sun gear 81, and each pinion gear 82 is rotatably supported by the carrier 83.

The carrier 83 is connected (shaft coupled) with the inner shaft 4. The carrier 83 is a kind of link connecting the pinion gear 82 and the inner shaft 4. That is, as the pinion gear 82 revolves around the sun gear 81, the carrier 83 rotates so that the inner shaft 4 rotates.

The carrier 83 includes an upper plate portion 831 formed with a boss 831*a* connected with the inner shaft 4, a lower plate portion 832 spaced downward from the upper plate portion 831 and provided with a through hole through which the drive shaft 10*a* passes, and a gear shaft 833 connecting the upper plate portion 831 and the lower plate portion 832. A plurality of gear shafts 833 may be provided along the circumferential direction, and the pinion gear 82 may be mounted on each gear shaft 833.

The gear shaft 833 is rotatably mounted with respect to the upper plate portion 831 and/or the lower plate portion 832 so that the pinion gear 82 and the gear shaft 833 can rotate together. Alternatively, the rotation of the gear shaft 833 may be restrained and the pinion gear 82 may be rotated with respect to the gear shaft 833.

The boss 831*a* formed in the upper plate portion 831 may be positioned in the boss 533 formed in the upper housing 53, and a bearing 32 may be interposed between the boss 831*a* and the outer shaft 9.

Hereinafter, the operation of the clutch 6 will be described with reference to FIG. 4.

FIG. 4(*b*) shows a state in which the clutch 6 reaches the maximum lifting position. In this state, when the inner shaft 4 rotates in the forward direction, the outer shaft 9 rotates in the forward direction because the clutch 6 cannot be raised any further. This is the case in which the pulsator 3 and the inner tub 2 are rotated together in the forward direction.

On the other hand, when the inner shaft 4 is rotated in the reverse direction while the clutch 6 is in the maximum raised position, the clutch 6 is lowered. When the drive shaft 10*a* is rotated in a state where the clutch 6 is positioned between the maximum raised position and the maximum lowered position, rotation of the outer shaft 9 may be caused by the load or inertia of the inner tub 2. That is, when the load applied to the outer shaft 9 from the inner tub 2 is sufficiently large, only the inner shaft 4 is rotated while the outer shaft 9 is maintained in a stopped state. However, when the load is not sufficient to restrain the rotation of the outer shaft 9, the outer shaft 9 can be rotated in the opposite direction to the inner shaft 4.

FIG. 3(*a*) shows the operation of the planetary gear train, when the drive shaft 10*a* is rotated in the reverse direction so that the clutch 6 is lowered. Assuming that the rotation of the ring gear 84 is restrained, if the drive shaft 10*a* is rotated at the angular velocity W1, it may be seen that the carrier 83 is rotated at the angular velocity W3 in the same direction as the drive shaft 10*a*. (W1>W3)

On the other hand, depending on the maximum angle (or the number of revolutions) at which the clutch 6 can be continuously rotated between the maximum lowered position and the maximum raised position, the maximum angle (or the number of revolutions) at which the pulsator 3 can be continuously rotated in the state where the inner tub 2 is stopped may be determined.

In a section in which the clutch 6 is lifted, the pulsator 3 may be rotated in a forward or backward direction according to the rotation direction of the motor 10. That is, particularly, when the clutch 6 does not reach the maximum raised position or the maximum lowered position, and is positioned between these positions, the rotation direction of the pulsator 3 is determined depending on the rotation direction of the inner shaft 4. Thus, the agitating rotation of the pulsator 3 may be induced by controlling the rotation direction of the motor 10.

FIG. 4(*a*) shows a state in which the clutch 6 reaches the maximum lowered position. In this state, when the inner shaft 4 is rotated in the reverse direction, the outer shaft 9 also rotates in the reverse direction because the clutch 6 cannot lower any further. This is the case in which the pulsator 3 and the inner tub 2 are rotated together in the reverse direction.

FIG. 3(*b*) shows a case where the drive shaft 10*a* is continuously rotated in the reverse direction in the state where the clutch 6 is in the maximum lowered position, that is, a case where the pulsator 3 and the inner tub 2 are rotated together. It can be seen that both the carrier 83 and the ring gear 84 are rotated integrally (i.e., at the same angular speed) in the same direction as the drive shaft 10*a*.

Figure 7:
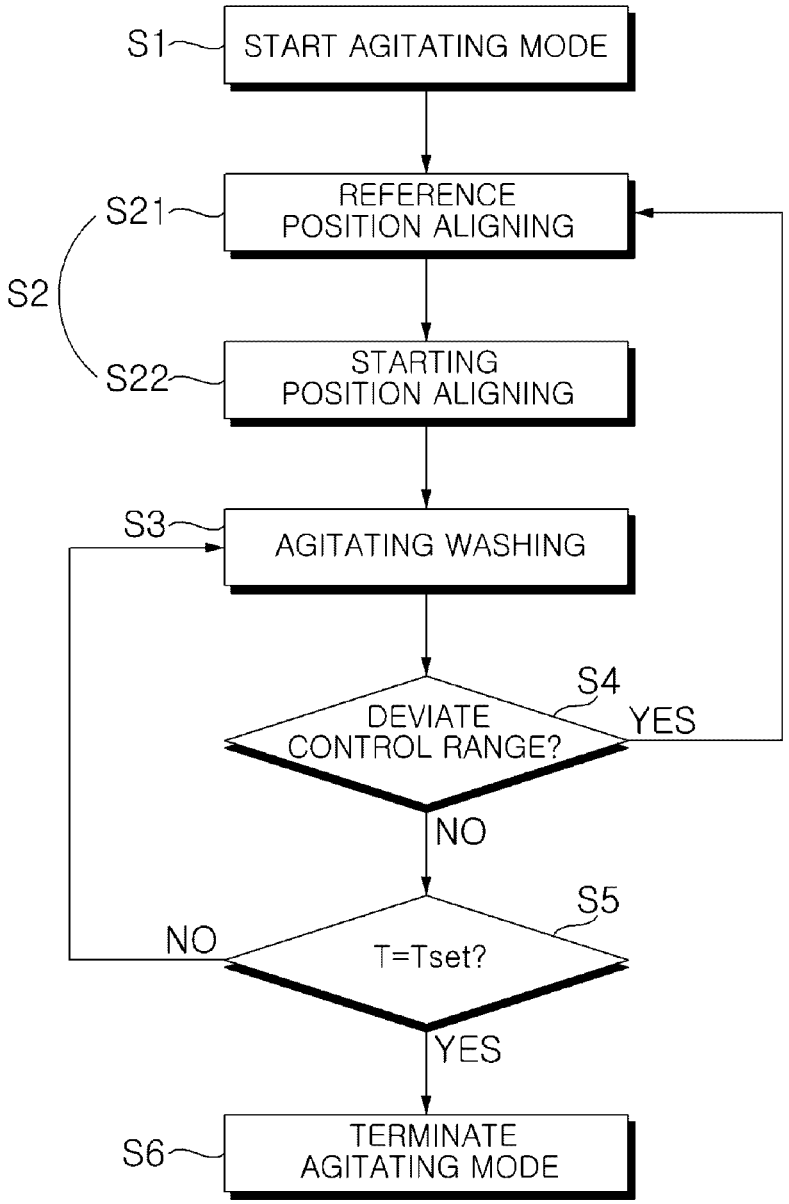
FIG. 7 is a flowchart illustrating a method of controlling a washing machine according to an embodiment of the present invention.
Figures 8A, 8B, 8C:
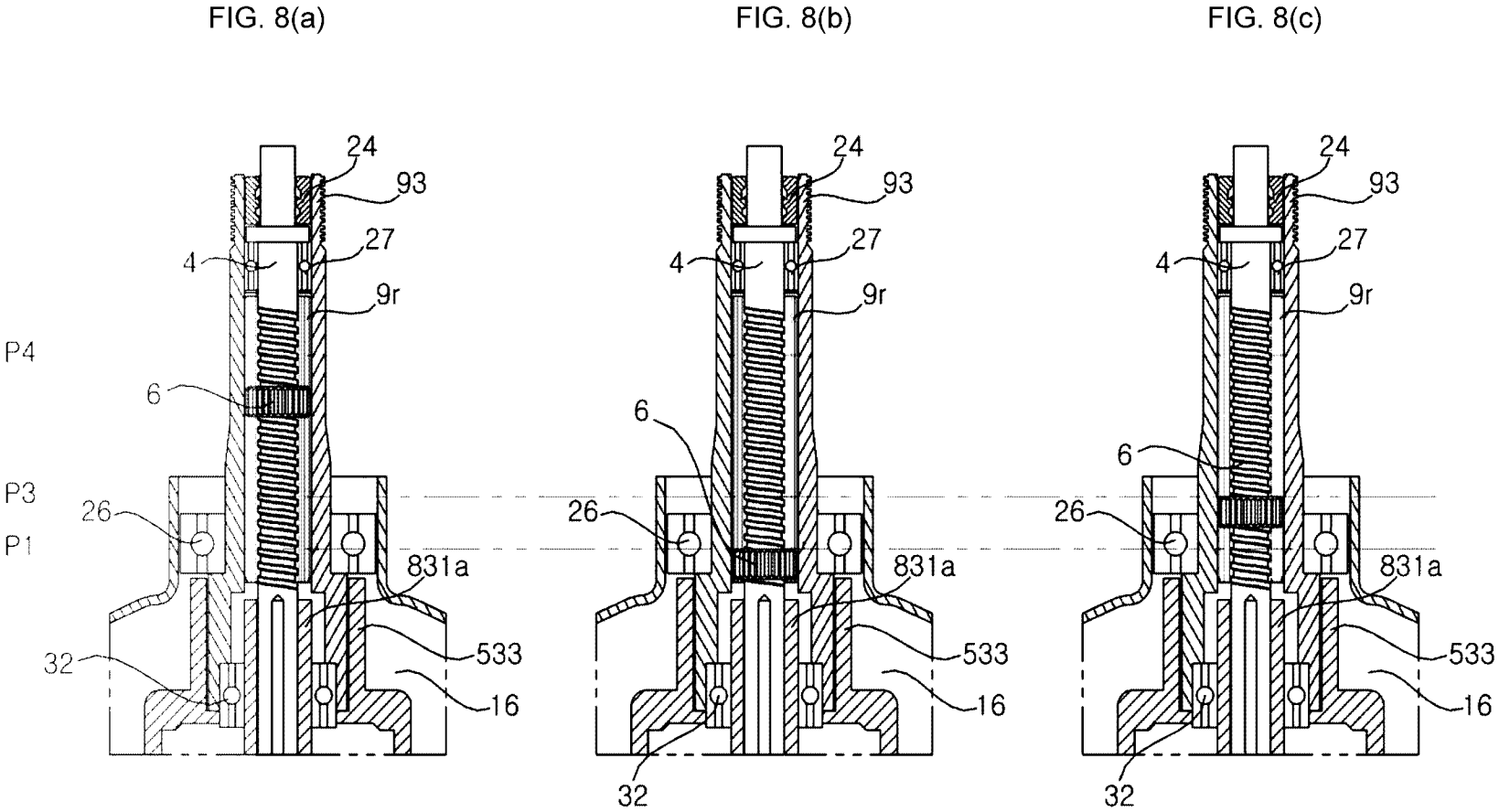
FIGS. 8(*a*), 8(*b*) and 8(*c*) illustrate the positions of a clutch in the process of initializing the position of the clutch.
Figure 9:
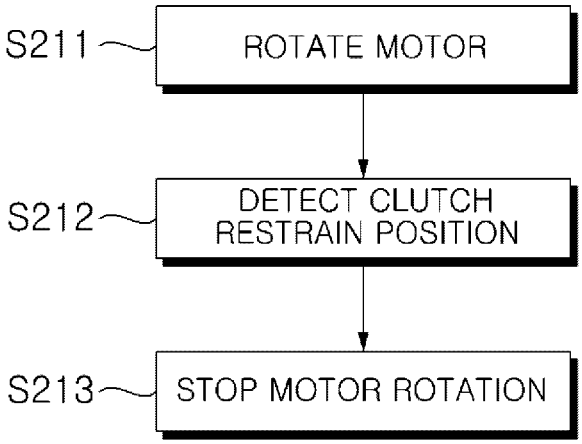
FIG. 9 illustrates detailed steps configuring a reference position aligning step.

FIG. 7 is a flowchart illustrating a method of controlling a washing machine according to an embodiment of the present invention. FIGS. 8(*a*), 8(*b*) and 8(*c*) illustrate the positions of a clutch in the process of initializing the position of the clutch. FIG. 9 illustrates detailed steps configuring a reference position aligning step. Hereinafter, a method of controlling a washing machine according to an embodiment of the present invention will be described with reference to FIGS. 5 to 9.

An agitating mode and a spin mode may be classified according to the rotating system of the pulsator 3 and the inner tub 2. In the agitating mode, the motor 10 is driven in a state in which the connection between the inner shaft 4 and the outer shaft 9 is released, and the clutch 6 is positioned between the maximum raised position and the maximum lowered position. In the agitating mode, when laundry or water is sufficiently contained in the inner tub 2 and the load acting on the outer shaft 9 is large, only the pulsator 3 is rotated in a state where the inner tub 2 is stopped. However, when the load acting on the outer shaft 9 is not sufficient to maintain the inner tub 2 in a stopped state, the outer shaft 9 is rotated in the opposite direction to the inner shaft 4 due to the torque transmitted through the planetary gear train 8.

In the agitating mode, the pulsator 3 may be alternately rotated in both directions by switching the rotation direction of the motor 10 repeatedly. The agitating mode is mainly used for uniformly dispersing laundry inputted into the inner tub 2 or used for washing or rinsing when water is contained in the inner tub 2.

In the spin mode, the motor 10 is driven in a state where the inner shaft 4 and the outer shaft 9 are connected. In the spin mode, the clutch 6 is positioned in the maximum raised position or the maximum lowered position, and the pulsator 3 and the inner tub 2 are rotated together in the same direction. The spin mode is mainly used for dewatering, but may also be used for forming a rotating water stream during washing or rinsing.

Meanwhile, in the agitating mode, the clutch 6 rises or lowers according to the rotation direction of the motor 10. At this time, the rotation of the motor 10 should be controlled so that the clutch 6 may not reach the maximum raised position or the maximum lowered position. This is because when the motor 10 continues to rotate in the same direction in the state where the clutch 6 reaches the maximum raised position or the maximum lowered position, the spin mode is performed.

When the clutch 6 reaches the maximum raised position or the maximum lowered position even for a while, the clutch 6 cannot be relatively rotated with respect to the inner shaft 4 and thus bears the torque for rotating the outer shaft 9. Such a load applied to the clutch 6 is unnecessary in the agitating mode, adversely affects the durability of the clutch 6, and the noise that is generated when the clutch 6 collides with the upper stopper or the lower stopper is also not desirable. Therefore, it is necessary to prevent the clutch 6 from reaching the maximum raised position or the maximum lowered position in the agitating mode, or to stop the driving of the motor 10 by quickly identifying such a situation when the situation occurs unintentionally. Hereinafter, a method of controlling a washing machine according to an embodiment of the present invention will be described in detail.

P1 to P6 shown in FIG. 5 indicate the position of an upper end of the clutch 6, and it is defined that P1 is a maximum lowered position, P2 is a lower end permitting position, P3 is a lower end starting position, P4 is an upper end starting position, P5 is an upper end permitting position, and P6 is a maximum raised position. Here, the respective positions are defined based on the upper end of the clutch 6.

The maximum lowered position P1 is the lowest point to which the clutch 6 can lower, and is a position when the clutch 6 is moved to the lowest point by the thread 41. However, in the case where the lower stopper is separately provided according to the embodiment, it may be a position of the clutch 6 in the state where further movement is restricted by the lower stopper.

The lower end starting position P3 is a position where the clutch 6 lowers to the lowest position in the agitating mode, and the upper end starting position P4 is a position where the clutch 6 rises to the highest position in the agitating mode. That is, in the agitating mode, the controller 91 alternately rotates the motor 10 in the forward/reverse direction to raise/lower the clutch 6, and controls the clutch 6 to move between the lower end starting position P3 and the upper end starting position P4.

When a section between the lower end starting position P3 and the upper end starting position P4 are defined as an agitating control section ST, the upper end starting position P4 corresponding to the upper limit of the agitating control section ST is spaced downward by a preset first distance d1 from the maximum raised position P6, and the lower end starting position P3 corresponding to the lower limit of the agitating control section ST is spaced upward by a preset second distance d2 from the maximum lowered position P1.

The lower end permitting position P2 is a position defined between the maximum lowered position P1 and the lower end starting position P3, and the upper end permitting position P5 is a position defined between the upper end starting position P4 and the maximum raised position P6.

The maximum raised position P6 is the highest point to which the clutch 6 can rise, and is a position when the clutch 6 is moved to the highest point by the thread 41. However, when the upper stopper is separately provided according to the embodiment, it may a position of the clutch 6 in the state where further rising is restricted by the upper stopper.

Meanwhile, when the agitating mode is started (S1) in FIG. 7, a step S2 (an initializing step) of initializing the position of the clutch 6, and a step S3 (an agitating washing step) of agitating the pulsator 3 while controlling the position of the clutch 6 within a preset range are sequentially performed.

The initializing step S2 includes a reference position aligning step S21 for rotating the motor 10 in a first direction and aligning the clutch 6 to a reference position and a starting position aligning step S22 for moving the clutch 6 from the reference position and aligning the clutch 6 to a starting position (see the process from FIG. 8(*a*) to FIG. 8(*b*)).

First, the reference position aligning step S21 will be described. The reference position is previously set to one of the maximum raised position P6 and the maximum lowered position P1. Hereinafter, it is described that the reference position is the maximum lowered position P1. In this case, the first direction is a reverse direction (a direction in which the motor 10 is rotated so that the clutch 6 lowers). According to an embodiment, when the reference position is set to the maximum raised position P6, the first direction is a forward direction (the opposite direction of the reverse direction).

The controller 91 controls the motor 10 to rotate in the reverse direction by a preset reference alignment angle θa. The rotation control of the motor 10 may be achieved based on the position em of the rotor 11 detected by the position detector 94.

The reference alignment angle θa is set according to the displacement of the clutch 6 from the maximum raised position P6 to the maximum lowered position P1. When the pitch of the thread 41 formed in the inner shaft 4 is constant, if the motor 10 is rotated in the reverse direction by the reference alignment angle θa in a state where the clutch 6 is at the maximum raised position P6, the clutch 6 lowers to the maximum lowered position P1. That is, when the displacement of the clutch 6 becomes a maximum (i.e., a distance between the maximum raised position P6 and the maximum lowered position P1), the motor 10 is rotated in one direction by the reference alignment angle θa.

The speed control system controls the rotation of the motor 10 to follow the command speed ωm* applied by the controller 91. At this time, the controller 91 controls the rotation of the motor 10 based on the position θm detected by the position detector 94.

In a state where the clutch 6 is positioned in an arbitrary point on the inner shaft 4, until the clutch 6 reaches the reference position (the maximum lowered position P1 in this example) as the motor 10 is rotated in the first direction under the control of the controller 91, the motor 10 can be rotated by the reference alignment angle θa to the max.

Unless the drive of the motor 10 is started in a state where the clutch 6 is at one of the maximum lowered position P1 or the maximum raised position P6 (the maximum lowered position P1 in the case where the maximum raised position P6 is the reference position according to the embodiment), the motor 10 cannot rotate the entire reference alignment angle θa. That is, in most cases, the clutch 6 reaches the maximum lowered position P1 before the rotation of the motor 10 reaches the reference alignment angle θa. Therefore, in the reference position aligning step S21, when the clutch 6 reaches an initial position, it is necessary to brake the motor 10 even if the rotation of the motor 10 is not achieved by the reference alignment angle θa.

The controller 91 may determine whether the clutch 6 reached the maximum lowered position P1 based on the current of the motor 10. Specifically, when the current value Idc of the motor 10 is equal to or greater than a preset first current value I1 while the inner shaft 4 is being rotated in the reverse direction, the controller 91 may determine that the clutch 6 reached the maximum lowered position P1 and may stop the rotation of the motor 10. (S211, S212, S213)

When the clutch 6 reaches the maximum lowered position P1 and the inner shaft 4 and the outer shaft 9 are connected to each other, the current value Idc is also sharply increased due to a sudden increase in the load applied to the motor 10. Therefore, when the current value Idc at this time becomes equal to or greater than the first current value I1, the controller 91 determines that the clutch 6 reached the maximum lowered position P1 and may brake the motor 10 (S212, S213). In particular, even when the rotation of the motor 10 does not reach the reference alignment angle θa, the time required for initializing the clutch 6 may be shortened by braking the motor 10.

Meanwhile, in some cases, depending on the load conditions applied to the motor 10, the current value Idc may become the first current value I1 even when the clutch 6 is not at the maximum lowered position P1 at the initial time of starting (i.e., until a certain time elapses from the point of time when the current Idc is applied to the stopped motor 10). That is, there may be a case where a current larger than the first current value I1 is required to start the motor 10 in a stopped state because the load applied to the pulsator 3 is large.

Therefore, it is preferable that the large current value generated at the initial time of the starting should be excluded in determining the position of the clutch 6. In this aspect, the controller 91 may control the motor 10 to stop rotating based on the detected current value Idc of the motor 10 after the inner shaft 4 starts rotating in the reverse direction and a first set time T1 is elapsed. That is, the motor 10 is braked when the current value Idc detected after the motor 10 is started and the first set time T1 is elapsed is equal to or greater than the first current value I1.

Meanwhile, according to the embodiment, when the current value Idc of the motor 10 is detected as a second current value I2, a third current value I3, and a fourth current value I4 sequentially at the initial time of the starting (i.e., within a second set time T2 after the motor 10 starts rotating in the reverse direction), the controller 91 determines that the clutch 6 has reached the maximum lowered position P1 and may brake the motor 10 even if the rotation does not reach the reference alignment angle θa.

The second current value I2 corresponds to the current value of the time point when the motor 10 starts. When the motor 10 starts, the stillness inertia of the pulsator 3 should be overcome, so that a considerable amount of current is applied to the motor 10, and the current value at this time may be the second current value I2.

The third current value I3 corresponds to the current value of the time point when the clutch 6 reaches a reference position and the inner shaft 4 and the outer shaft 9 are connected. When the inner shaft 4 and the outer shaft 9 are connected to each other, the current value Idc is rapidly increased due to a sudden increase in the load applied to the motor 10. The current value Idc, at this time, may become the third current value I3.

The fourth current value I4 corresponds to the current value of the time point when the inner shaft 4 and the outer shaft 9 are connected and rotated integrally. That is, the fourth current value I4 is set based on the current value Idc of the time point when the motor 10 continues to rotate in the reverse direction in a state in which the clutch 6 reaches the reference position (the maximum lowered position P1 in the embodiment) and the inner shaft 4 and the outer shaft 9 are connected. In particular, preferably, the fourth current value I4 is determined based on the current value Idc of the time point when the rotation of the outer shaft 9 starts.

As described above, the case where the second current value I2, the third current value I3, and the fourth current value I4 are sequentially detected within the second set time T2 corresponds to the case where the motor 10 is started in a state where the clutch 6 is separated from the maximum lowered position P1 within a distance corresponding to the second set time T2, the position of the clutch 6 reaches the maximum lowered position P1 within the second set time T2, and thereafter, a series of processes in which the rotation of the outer shaft 9 is started are performed. In this case, as the second set time T2 is set to be shorter, the series of current values detected as described above becomes an indicator for determining that the clutch 6 starts to lower from a position near the reference position at the starting point of the motor 10 and reaches the reference position That is, based on the series of current values I2, I3, I4 detected as described above, the controller 91 may determine that the clutch 6 has already been aligned to the maximum lowered position P1 before the rotation of the motor 10 reaches the reference alignment angle θa as the initial position of the clutch 6 is close to the maximum lowered position P1. Therefore, when the clutch 6 reaches the maximum lowered position P1 before the rotation of the motor 10 reaches the reference alignment angle θa, the time required for initializing the position of the clutch 6 can be reduced by omitting the rotation of the motor 10 as much as the remaining angle.

After the clutch 6 is aligned to the reference position, the starting position aligning step S22 is performed. The starting position aligning step S22 is a step of moving the clutch 6 from the reference position and aligning the clutch 6 to a preset starting position. (see the process from FIG. 8(*b*) to FIG. 8(*c*)).

The controller 91 controls the rotation of the motor 10 by the starting alignment angle θb so that the clutch 6 is moved from the starting position to a target position corresponding to the other one of the upper limit and the lower limit of the agitating control section ST. When the starting position is the lower end starting position P3 of the agitating control section ST and the target position is the upper end starting position P4 of the agitating control section ST, the motor 10 is rotated in the forward direction by the starting alignment angle θb. On the other hand, when the starting position is the upper end starting position P4 of the agitating control section ST and the target position is the lower end starting position P3 of the agitating control section ST, the motor 10 is rotated in the reverse direction by the starting alignment angle θb.

Here, the starting alignment angle θb is an angle at which the motor 10 is rotated while the clutch 6 is moved from the lower end starting position P3 of the agitating control section ST to the upper end starting position P4 (or while moving from the upper end starting position P4 to the lower end starting position P3). Since the lower end starting position P3 and the upper end starting position P4 of the agitating control section ST are previously set, the starting alignment angle θb set in correspondence with the distance between both positions is also a preset value.

The controller 91 determines whether the rotational angle θm of the rotator has reached the starting alignment angle θb based on the position θm detected by the position detector 94. When it is determined that the rotator has reached the starting alignment angle θb, the controller 91 may brake the motor 10. After the motor 10 is stopped by the braking, the agitating washing step S3 may be performed.

In the agitating washing step S3, the inner shaft 4 is alternately rotated in both directions in a state in which the connection between the inner shaft 4 and the outer shaft 9 is released. In the agitating washing step S3, the controller 91 controls the rotation of the motor 10 so that the clutch 6 does not reach either the maximum lowered position P1 or the maximum raised position P6.

Specifically, the controller 91 controls the rotation of the motor 10 to be rotated by the agitating control angle θd corresponding to the displacement from the lower end starting position P3 to the upper end starting position P4, or from the upper end starting position P4 to the lower end starting position P3, corresponding to the upper limit and the lower limit of the agitating control section ST.

Here, since the lower end starting position P3 and the upper end starting position P4 are previously set, the agitating control angle θd of the rotator of the motor 10 to be rotated so as to move the clutch 6 by the distance between the lower end starting position P3 and the upper end starting position P4 is also previously set. The controller 91 may control the motor 10 to rotate in the forward direction (second direction) by the agitating control angle θd and then rotate the motor 10 in the reverse direction (first direction) by the agitating control angle θd so that the clutch 6 returns from the upper end starting position P4 to the lower end starting position P3. These processes may be repeated a plurality of times, so that the pulsator 3 may be repeatedly rotated in the forward/reverse direction.

Since the rotation direction of the motor 10 is based on the position em of the rotator detected by the position detector 94, when the motor 10 is braked after the rotation angle of the rotator detected by the position detector 94 reaches the agitating control angle θd, the motor 10 is still rotated by a certain angle due to the rotational inertia until the motor 10 is completely stopped as long as the motor 10 is not completely braked immediately.

Alternatively, the method in which the motor 10 is braked at the time point when the rotation angle θm detected by the position detector 94 does not reach the agitating control angle θd, and the motor 10 is controlled so that the total rotation angle which is obtained by considering the inertia rotation at the time point when the motor 10 is stopped reaches the agitating control angle θd. However, in this case as well, the time point when the braking of the motor 10 is started may be determined by predicting a state in which the motor 10 is completely stopped, there is a certain degree of variation in the distance that the clutch 6 moves until the motor 10 is temporarily stopped in a direction change process.

In any case, when the position where the clutch 6 is temporarily stopped in the direction change process deviates downward from the lower end starting position P3 by a certain distance or more (when the rotation of the motor 10 is changed from the reverse direction to the forward direction), or deviates upward from the upper end starting position P4 by a certain distance or more (when the rotation of the motor 10 is changed from the forward direction to the reverse direction), that is, when the control of the moving distance of the clutch 6 is not performed within a permissible range, there is a risk that the clutch 6 may reach the reference position (i.e., the maximum lowered position P1 or the maximum raised position P6).

In order to avoid such a problem, the lower end permitting position P2 and the upper end permitting position P5 are limits set to allow the displacement of the clutch 6. That is, preferably, it is required that the lowering of the clutch 6 is permitted up to the lower end permitting position P2 while the rotation direction of the motor 10 is changed in the agitating mode, and the rising of the clutch 6 is permitted up to the upper end permitting position P5.

The controller 91 determines whether the clutch 6 has reached the lower end permitting position P2 or the upper end permitting position P5 based on the position θm detected by the position detector 94 while the agitating washing step S3 is performed (S4). If it is determined that the clutch 6 has reached the lower end permitting position P2 or the upper end permitting position P5, that is, if it is determined that the clutch 6 deviates from a control range (i.e., the section between the lower end permitting position P2 and the upper end permitting position P5) (S4), the controller 91 may brake the motor 10.

After the agitating mode is started, when it reaches a preset agitating washing time (Tset), the agitating mode is terminated (S5, S6).

Alternatively, the controller 91 may control to perform again the reference position aligning step S21, when a preset continuous driving time elapses from the time point at which the agitating washing step S3 is performed (i.e., at the time point when the motor 10 is started to move the clutch 6, which is first aligned to the starting position P3 or P4, to the target position P4 or P3), while the agitation washing step S3 is performed. Thereafter, if the agitating washing time (Tset) has not elapsed, the starting position aligning step S22 and the agitating washing step S3 are sequentially performed again. When the continuous driving time is arrived again after the agitating washing step S3 is started, the reference position aligning step S21, the starting position aligning step S22, and the agitating washing step S3 may be performed. These steps are continued until the agitating washing time (Tset) is met after the agitating washing step S3 is started.

The washing machine according to the present invention and the control method for a washing machine precisely control the range of the vertical movement of the clutch which is interposed between the inner shaft and the outer shaft so as to rise and lower according to the rotation of the inner shaft and to connect or disconnect the inner shaft and the outer shaft, thereby preventing the clutch from reaching the maximum raised position or the maximum lowered position at which the inner shaft and the outer shaft are connected to each other in the process of switching the rotating direction of the pulsator.

Therefore, when the agitating washing is performed by rotating the pulsator alternately in both directions, it is stably performed in a state where the inner shaft and the outer shaft are disconnected, and it is possible to prevent the occurrence of interference or impact between the components and unnecessary noise due to malfunction (i.e., connection of the inner shaft and the outer shaft) of the clutch during the agitating washing.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

What is claimed is:

1. A method of controlling a washing machine provided with an outer tub, an inner tub located in the outer tub, a pulsator located in the inner tub, an outer shaft configured to rotate the inner tub, an inner shaft located in the outer shaft and configured to rotate the pulsator, a motor configured to rotate the inner shaft, and a clutch configured to selectively transmit rotation of the inner shaft to the outer shaft, the clutch and the inner shaft being interconnected by a threaded interface, and the clutch and the outer shaft being interconnected by an anti-rotation interface, so that rotation of the inner shaft with respect to the outer shaft in a forward direction raises the clutch to a preset maximum raised position where the clutch is restrained from being raised further and the outer shaft rotates in the forward direction together with the inner shaft, and rotation of the inner shaft with respect to the outer shaft in a reverse direction lowers the clutch to a preset maximum lowered position where the clutch is restrained from being lowered further and the outer shaft rotates in the reverse direction together with the inner shaft, the method comprising:

(a) rotating the motor in a first direction to drive the inner shaft to position the clutch at a reference position corresponding to one of the maximum lowered position and the maximum raised position;

(b) rotating the motor in a second direction by a preset reference alignment angle to move the clutch from the reference position to a starting position corresponding to one of an upper limit and a lower limit of an agitating control section, wherein the upper limit of the agitating control section is spaced downward by a first distance from the maximum raised position, and wherein the lower limit of the agitating control section is spaced upward by a second distance from the maximum lowered position; and (c) rotating the motor by a starting alignment angle set according to a displacement of the clutch from the starting position to a target position corresponding to the other one of the upper limit and the lower limit of the agitating control section so that the clutch moves from the starting position to the target position.

2. The method of claim 1, further comprising:

(d) rotating the motor so that the clutch returns from the target position to the starting position.

3. The method of claim 2, further comprising repeating (c) and (d) a plurality of times.

4. The method of claim 3, further comprising performing (a) again when the clutch reaches a preset permitting position beyond the agitating control section while (c) and (d) are being repeatedly performed.

5. The method of claim 3, further comprising performing (a) again when a set time elapses from a time point when (c) is first performed.

6. The method of claim 1, further comprising, when performing (a), controlling the motor to rotate in the first direction by a reference alignment angle set corresponding to a displacement of the clutch between the maximum raised position and the maximum lowered position.

7. The method of claim 1, further comprising, when performing (a), determining that the clutch has reached the reference position and braking the motor when a current value of the motor being rotated in the first direction is equal to or greater than a preset first current value.

8. The method of claim 7, further comprising braking the motor based on the current value of the motor that is detected after a first set time has elapsed after the motor is started in the first direction.

9. The method of claim 7, further comprising, when performing (a), determining that the clutch has reached the reference position and stopping the motor when a second current value, a third current value and a fourth current value are sequentially detected, wherein the second current value corresponds to a current value at a time point when the motor is started within a second set time after the motor starts rotating in the first direction, wherein the third current value corresponds to a current value at a time point when the clutch reaches the maximum raised position or the maximum lowered position and the inner shaft and the outer shaft are connected, and wherein the fourth current value corresponds to a current value at a time point when the inner shaft and the outer shaft are connected and rotated integrally after the third current value is detected.

10. A washing machine, comprising:

an outer tub provided to accommodate wash water therein;

an inner tub located in the outer tub, the inner tub being provided to accommodate laundry therein;

a pulsator located in the inner tub;

an outer shaft configured to rotate the inner tub;

an inner shaft located in the outer shaft, the inner shaft being configured to rotate the pulsator;

a motor configured to rotate the inner shaft;

a clutch configured to selectively transmit rotation of the inner shaft to the outer shaft, the clutch and the inner shaft being interconnected by a threaded interface, and the clutch and the outer shaft being interconnected by an anti-rotation interface, so that rotation of the inner shaft with respect to the outer shaft in a forward direction raises the clutch to a preset maximum raised position where the clutch is restrained from being raised further and the outer shaft rotates in the forward direction together with the inner shaft, and rotation of the inner shaft with respect to the outer shaft in a reverse direction lowers the clutch to a preset maximum lowered position where the clutch is restrained from being lowered further and the outer shaft rotates in the reverse direction together with the inner shaft; and a controller configured to:

(a) rotate the motor in a first direction to drive the inner shaft to position the clutch at a reference position corresponding to one of the maximum lowered position and the maximum raised position;

(b) rotate the motor in a second direction by a preset reference alignment angle to move the clutch from the reference position to a starting position corresponding to one of an upper limit and a lower limit of an agitating control section, wherein the upper limit of the agitating control section is spaced downward by a first distance from the maximum raised position, and wherein the lower limit of the agitating control section is spaced upward by a second distance from the maximum lowered position; and (c) rotate the motor by a starting alignment angle set according to a displacement of the clutch from the starting position to a target position corresponding to the other one of the upper limit and the lower limit of the agitating control section so that the clutch moves from the starting position to the target position.

11. The washing machine of claim 10, wherein the controller is further configured to:

(d) rotate the motor so that the clutch returns from the target position to the starting position.

12. The washing machine of claim 11, wherein the controller is further configured to repeat (c) and (d) a plurality of times.

13. The washing machine of claim 12, wherein the controller is further configured to perform (a) again when the clutch reaches a preset permitting position beyond the agitating control section while (c) and (d) are being repeatedly performed.

14. The washing machine of claim 12, wherein the controller is further configured to perform (a) again when a set time elapses from a time point when (c) is first performed.

15. The washing machine of claim 10, wherein the controller is further configured to, when performing (a), control the motor to rotate in the first direction by a reference alignment angle set corresponding to a displacement of the clutch between the maximum raised position and the maximum lowered position.

16. The washing machine of claim 10, wherein the controller is further configured to, when performing (a), determine that the clutch has reached the reference position and brake the motor when a current value of the motor being rotated in the first direction is equal to or greater than a preset first current value.

17. The washing machine of claim 16, wherein the controller is further configured to perform braking of the motor based on the current value of the motor that is detected after a first set time has elapsed after the motor is started in the first direction.

18. The washing machine of claim 16, wherein the controller is further configured to, when performing (a), determine that the clutch has reached the reference position and stop the motor when a second current value, a third current value and a fourth current value are sequentially detected, the second current value corresponding to a current value at a time point when the motor is started within a second set time after the motor starts rotating in the first direction, the third current value corresponding to a current value at a time point when the clutch reaches the maximum raised position or the maximum lowered position and the inner shaft and the outer shaft are connected, and the fourth current value corresponding to a current value at a time point when the inner shaft and the outer shaft are connected and rotated integrally after the third current value is detected.

19. The washing machine of claim 10, further comprising:

a planetary gear train provided between the motor and the inner shaft to transfer torque of the motor to the inner shaft; and a gear housing coupled to the outer shaft to accommodate the planetary gear train therein.

20. The washing machine of claim 19, wherein the planetary gear train comprises:

a ring gear fixed to an inner circumferential surface of the gear housing;

a sun gear connected to a drive shaft of the motor;

a plurality of pinion gears engaged with the sun gear and the ring gear; and a carrier rotatably supporting the pinion gears, the carrier being configured to rotate when the pinion gears revolve around the ring gear, the carrier being connected to the inner shaft to rotate the inner shaft.

* * * * *